US005481883A

United States Patent [19]

Harkness, Jr. et al.

[11] Patent Number: 5,481,883

[45] Date of Patent: Jan. 9, 1996

[54] METHOD AND APPARATUS FOR REDUCTION OF REFRIGERANT GASES ESCAPING FROM REFRIGERATION SYSTEMS

[76] Inventors: Charles A. Harkness, Jr.; Deborah A. Harkness, both of 5759 Windy Oaks Dr., Roanoke, Tex. 76262

[21] Appl. No.: 326,229

[22] Filed: Oct. 20, 1994

[51] Int. Cl.[6] ..... F25B 45/00

[52] U.S. Cl. ..... 62/77; 62/126; 62/129; 62/174; 165/71

[58] Field of Search ..... 62/77, 126, 129, 62/149, 174, 292, 85; 165/71

[56] References Cited

U.S. PATENT DOCUMENTS

| | | | |
|---|---|---|---|
| 2,893,217 | 7/1959 | Nigro | 62/126 |
| 3,232,070 | 2/1966 | Sparano | 62/149 |
| 4,539,817 | 9/1985 | Staggs et al. | 62/149 |
| 4,644,755 | 2/1987 | Esslinger et al. | 62/126 |
| 4,646,527 | 3/1987 | Taylor | 62/85 |
| 4,711,096 | 12/1987 | Krantz | 62/129 |
| 4,766,733 | 8/1988 | Scuderi | 62/77 |
| 4,768,347 | 9/1988 | Manz | 62/149 |
| 4,939,905 | 7/1990 | Manz | 62/77 |
| 5,333,468 | 8/1994 | Rice | 62/174 |
| 5,398,516 | 3/1995 | Kuribara | 62/129 |

*Primary Examiner*—John M. Sollecito
*Attorney, Agent, or Firm*—Jacobson, Price, Holman & Stern

[57] ABSTRACT

A refrigerant purging and storage system is provided operative, responsive to the operating pressure of refrigerant gas within the suction line dropping to a predetermined low pressure below the range of normal operating pressure of that suction line, to pump refrigerant gas from a closed-loop refrigerant circuit into a closed storage vessel, for a predetermined time period, only, and to prevent backflow of refrigerant gas from said storage vessel into said circuit.

7 Claims, 1 Drawing Sheet

METHOD AND APPARATUS FOR REDUCTION OF REFRIGERANT GASES ESCAPING FROM REFRIGERATION SYSTEMS

BACKGROUND OF THE INVENTION

FIELD OF THE INVENTION

The instant invention relates to a method and apparatus for sensing a drop in operating pressure below a predetermined range of operating pressure experienced by a low pressure refrigerant line of a closed-loop refrigerant circuit and wherein the sensed drop in pressure causes a refrigerant purging and storage system to pump, for a predetermined time only, refrigerant from the refrigerant circuit and to store the refrigerant in a pressure vessel, independent of return flow of refrigerant from the pressurized vessel into the refrigerant circuit.

DESCRIPTION OF RELATED ART

Various different forms of refrigerant containing systems, purging systems and recovery systems heretofore have been provided such as those disclosed in U.S. Pat. Nos. 4,644,755, 4,711,096, 4,768,347, 4,939,905, 4,766,733, 4,646,527, 3,232,070, 4,539,817 and 2,893,217. However, these previously known systems do not include the structural and operational features of the instant invention wherein substantially immediately upon the loss of refrigerant in a closed-loop refrigerant circuit a refrigerant purging apparatus is actuated, for a predetermined time interval only, to quickly purge substantially all remaining refrigerant from the closed-loop refrigerant circuit and to pump the purged refrigerant into a pressurized storage vessel.

U.S. Pat. No. 4,644,755 to Esslinger discloses a refrigeration system leak containment apparatus and method incorporating a control circuit and a flow continuity measuring means. The flow measuring means uses an infrared light source and infrared light detector adjacent a fluid viewing window to detect the continuity of liquid flow as measured by the change in index of refraction through the window. If a test condition is not met, the control circuit activates various peripheral devices which sound an alarm and cause the refrigerant fluid to be contained with a predetermined portion of the refrigeration system. Although the system so disclosed represents a significant advance over previous refrigerant recovery devices, further improvement remains desirable. Esslinger discloses containing the refrigerant in a predetermined portion of the existing refrigeration system by utilizing the existing compressor, condenser coil, a liquid receiver, an evaporator coil, and a refrigerant metering device, with other elements being optional, within the refrigerated system. This method and apparatus has significant drawbacks advance due to the high possibility of leaks occurring within the predetermined portions of the existing system. Also, in the case of compressor failure in the refrigerated system, the Esslinger method and apparatus will prove unsuccessful in fulfilling the containment process.

U.S. Pat. No. 4,711,096 to Krantz discloses a system for sensing a leak of ammonia refrigerant into a refrigerated environment and for automatically purging the refrigeration equipment within the environment of the refrigerant. This method for sensing the leak of ammonia refrigerant utilizes several sensors, which are dispersed throughout the refrigerator or freezer, in order to detect the presence of ammonia gases within the refrigerator or freezer. Once detected, the ammonia gases are vented into the earth's atmosphere. However, the present invention functions to substantially terminate the loss of refrigerant into the atmosphere and to purge a closed-loop refrigerant circuit by pumping the refrigerant from the circuit and into an independent pressurized storage vessel.

U.S. Pat. No. 4,768,347 to Manz, U.S. Pat. No. 4,939,905 to Manz, U.S. Pat. No. 4,766,733 to Scuderi, U.S. Pat. No. 4,646,527 to Taylor, U.S. Pat. No. 3,232,070 to Sparano and U.S. Pat. No. 4,539,817 to Staggs all disclose portable refrigerant recovery systems. These systems require supervised operation. They must be manually transported and connected to the refrigerated system. Once the refrigerant is evacuated, if not already substantially fully lost, the recovery system must be manually disconnected and transported to the next location. Although these recovery systems represent an advance over each other, further improvements remain desirable.

U.S. Pat. No. 2,893,217 to Nigro discloses an automatic refrigerant charging system coupled with an alarm to a conventional warning system. This system is capable of automatically charging the refrigerant system with additional refrigerant when its original supply becomes low and at the same time giving a warning alarm both at the point of installation of the system and at a remotely located station of a conventional telephone, fire alarm, or burglary warning system.

SUMMARY OF THE INVENTION

The present invention incorporates a method and apparatus to reduce hazardous leakage of refrigerant gas from a closed-loop refrigerant circuit. The method and apparatus will detect a reduction of operating pressure within a low pressure refrigerant line upstream from a compressor below the predetermined range of operating pressure, which reduction in pressure occurs when refrigerant leaks from the closed-loop refrigerant circuit. In response to detecting such reduction in pressure, the remaining refrigerant gases are evacuated from the closed-loop refrigerant circuit and transferred and stored in a separate storage tank. The level of reduction in operating pressure for activation of the present invention is preferably at a pressure below normal operating pressure, but above that pressure which many refrigeration systems are set for automatic shut down.

Unlike the common recovery systems which are used today, the recovery system of the present invention will not require transportation from job site to job site because it is designed to accompany each individual refrigeration system. After initial installation, the present invention will not require physical manipulation to begin and complete the evacuation process. Recovery systems which are in use today are frequently operating on a daily basis on several different refrigeration systems. Therefore, a need exists for continuous maintenance to inhibit wear and tear. The present invention requires little or no maintenance because it is designed as an accessory to each individual refrigeration system, thereby reducing the need for frequent operation.

It is therefore, an important object of the instant invention to provide a new, improved and unique method and apparatus for automatically terminating loss of refrigerant from a refrigerant system which is experiencing a drop in pressure (below a predetermined range of normal operating pressure) within a low pressure refrigerant line upstream from the compressor.

The present invention does not depend upon utilizing the existing compressor in the refrigeration system nor will it require a predetermined portion of the existing refrigeration system to contain the refrigerant, thereby eliminating all possibilities of an unsuccessful containment process. Further, the present invention is an accessory to the existing refrigerating system.

Another object of this invention is to provide a method and apparatus which will automatically actuate an alarm upon sensing a low pressure operating condition while at the same time evacuating the refrigerant from the refrigerant system.

Yet another object of this invention is to provide an accessory system for a conventional refrigeration system of the closed-loop circuit type and wherein the accessory system also may be utilized to terminate operation of the existing refrigeration system, in the event the existing refrigeration system does not itself incorporate an automatic cut off mechanism.

A further object of this invention is to provide a new, improved and unique method and apparatus which will automatically evacuate and recover refrigerant from a refrigeration system with the present invention designed to be used as an accessory to an existing refrigerated system.

A still further object of the present invention is to detect blower motor failure, clogged filters, a clogged evaporator coil, expansion valve failure, capillary tube or flow rator failures, restrictions such as filter dryers or a collapsed suction line, stuck contactors, etc., by sensing a drop in low pressure refrigerant line operating pressure.

A final object of this invention to be specifically enumerated herein is to provide an apparatus which will conform to conventional forms of manufacture, be of simple construction and automatic in operation so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

The single appended drawing is a schematic diagram of the preferred refrigerant gas purging and reclaiming system in accordance with the present invention and in operative association with the low pressure refrigerant line of a typical mechanical refrigeration system including a closed-loop refrigerant circuit.

DESCRIPTION OF THE PREFERRED EMBODIMENT

Figure 1:
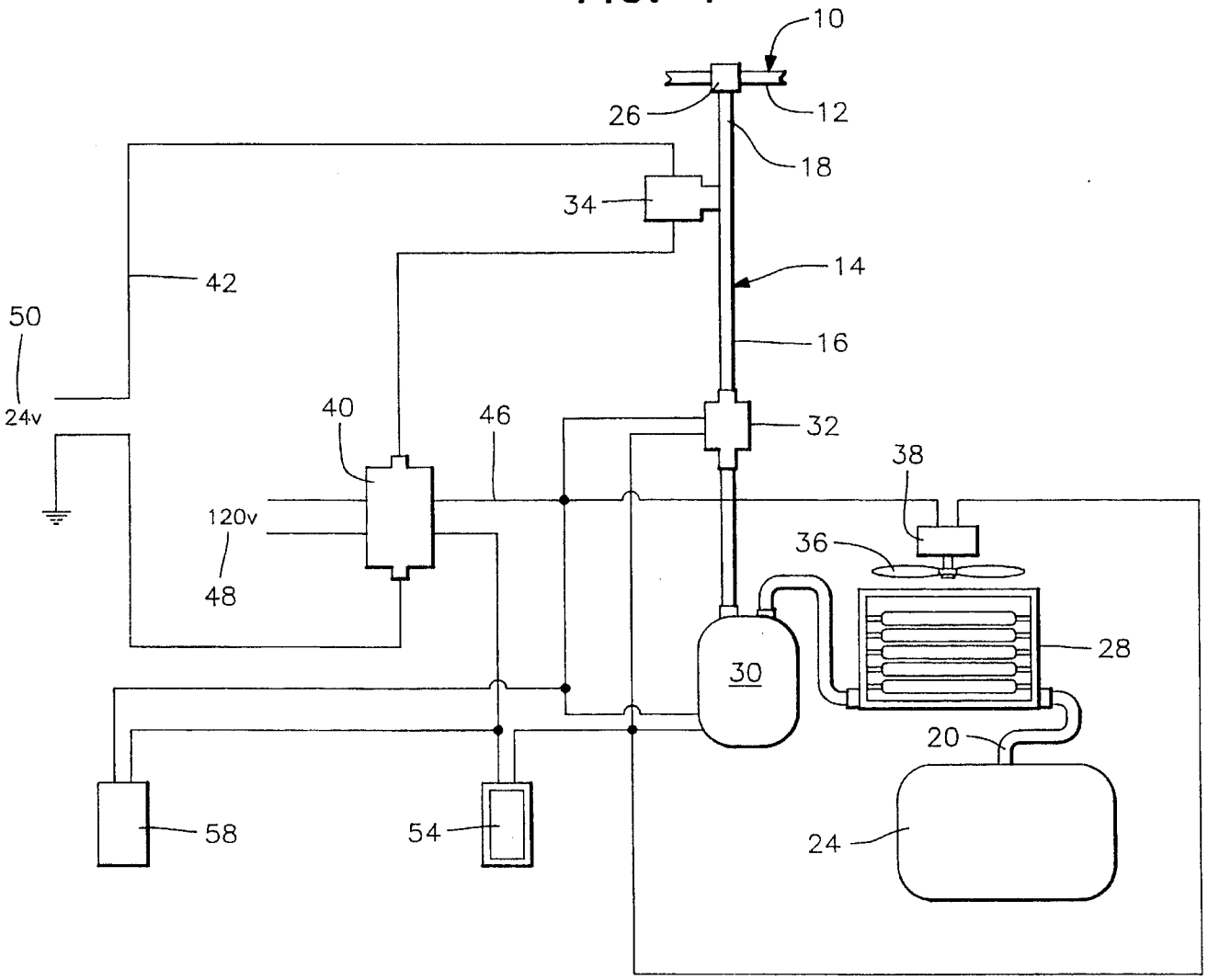

With reference now to the drawing, numeral 10 generally designates a closed-loop refrigerant circuit of a refrigeration system and the numeral 12 designates a low pressure refrigerant line of that circuit extending between the evaporator (not shown) and the inlet side of the compressor (not shown) of the refrigerant circuit.

The refrigerant gas purging and reclaiming system of the instant invention is referred to in general by the reference numeral 14 and includes a purge line 16 including an inlet end 18 and an outlet end 20. The outlet end 20 opens into a pressure vessel or tank 24 and the inlet end opens into the low pressure refrigerant line 12 through a suitable coupling fitting 26. In addition, the purge line 16 has a condenser 28, a compressor 30 and a normally closed solenoid valve 32 serially connected therein, the condenser 28 being interposed in the line 16 intermediate the compressor 30 and the pressure vessel or tank 24 and the compressor 30 being disposed in the line 16 intermediate the solenoid valve 32 and the condenser 28. Preferably, a normally open pressure switch 34 is communicated with the interior of the purge line 16 intermediate the fitting 26 and the solenoid valve 32. As an alternative, the pressure switch 34 could be communicated with the interior of the low pressure refrigerant line 12 either upstream or downstream from the fitting 26.

The condenser 28 is preferably air cooled by a fan assembly 36 driven by a 120 volt motor 38. The compressor also is a 120 volt compressor, while the solenoid 32 is also operable by 120 volts.

A 24 volt contactor 40 is serially connected within a 24 volt loop control circuit 42 in which the pressure switch 34 also is serially connected. The contactor includes a normally open switch serially connected in a 120 volt power circuit 46 and the circuit 46 is electrically connected to a 120 volt source 48 while the circuit 42 is electrically connected to a 24 volt source 50 and comprises pressure sensing switch means for actuating the circuit 46.

The solenoid valve 32 is electrically connected in parallel with the circuit 46 as are the motor 38 and compressor 30. However, a 120 volt timer 54 is serially connected in the circuit 46, the timer being of the type which will, upon the circuit 46 being closed by the contactor 40, maintain the circuit 46 closed for only a predetermined time interval after which the timer 54 will open the circuit 46. The predetermined time interval is preferably adjustable in order to accommodate different refrigerant circuits and different operating conditions.

The contactor switch controlling the circuit 46 is closed upon the contactor 40 being actuated by the 24 volt circuit 42 responsive to the pressure switch 34 sensing a lower than normal operating pressure within the low pressure refrigerant line 12. A notification device 58 (which may be in the form of a warning light, an audible alarm or some other alarm device) is connected in parallel with the circuit 46 and is thereby actuated when the circuit 46 is completed through the contactor 40 and actuation of the notification device is terminated upon the circuit 46 being opened. Thus, it may be seen that the pressure switch 34, contactor 40, solenoid valve 32 and timer 54 all function together as control means for opening valve 32 and driving compressor 30 for a predetermined time period in response to sensing low pressure in purge line 16 and thereafter terminating operation of compressor 30 and closing valve 32.

In operation, the low pressure refrigerant line of the closed-loop refrigeration system has an operating pressure ranging, generally, from 68 to 75 psi. With this operating range, the pressure switch 34 is designed to close the circuit 42 upon sensing a drop in pressure within the purged line 16 or the line 12 to preferably in the range of about 55 psi. It is to be noted that the pressure of the liquid refrigerant within the line 12 during periods of nonoperation of the closed-loop refrigerating circuit 10 is normally greater than 68–75 psi.

As soon as the pressure switch senses a drop in pressure to about 55 psi, the pressure switch 34 closes the circuit 42 to thereby actuate the contactor 40 to close the circuit 46. Therefore, the normally closed solenoid valve 32 is opened, the compressor 30 is actuated and the motor 38 for the fan 36 is also actuated. At the same time, the timer 54 is actuated and will thereafter function to open the circuit 46 after the predetermined time interval set for the particular refrigerant circuit and operating conditions. Depending upon the size of the closed-loop refrigeration circuit 10, the timer may be adjusted to open the circuit 46 for any time period between one minute and sixty minutes after the circuit 46 is initially closed by the contactor 40. Of course, after once being actuated, the timer 54 must be reset to a closed position after the closed-loop refrigerant circuit 10 has been repaired.

As soon as the circuit 46 is closed to actuate the compressor 30, the motor 38 and the timer 54 as well as the notification device 58, refrigerant gas is withdrawn from the closed-loop refrigerant circuit 10 through the purge line 16, cooled during passage through the condenser 28 and stored under pressure within the pressure vessel or tank 24. This continues for the length of time for which the timer 54 is preset according to the capacity of the compressor 30 and the amount of refrigerant normally contained within the refrigerant circuit 10. Thereafter, upon the timer 54 opening the circuit 46, the solenoid valve 32 immediately closes in order to prevent backflow of liquid refrigerant from the vessel or tank 24 into the refrigeration circuit 10, operation of the compressor 30 and motor 38 are terminated while the supply of current to the notification device 58 is maintained.

It is pointed out that most commercial closed-loop refrigerant circuits include a pressure switch similar to the pressure switch 34 which may be set to open below 55 psi and which is serially connected in the thermostat circuit of the existing refrigeration system to automatically terminate operation of the refrigeration system's compressor to avoid over heating thereof. The timer 54 is set to that time period in which the compressor 30 will be capable of pumping substantially all of the remaining refrigerant gases in the circuit 10 into the vessel or tank 24 after the initial low pressure operation of the refrigerant circuit 10 is sensed by the pressure switch 34. Therefore, once even a slow leak of refrigerant gases from the circuit 10 has reduced the operating pressure of the circuit 10 to the designated initiation pressure, about 55 psi, the remaining refrigerant within the circuit 10 is quickly pumped therefrom and stored for reuse. Not only does this amount to a considerable savings in refrigerant gas, but it also prevents a significant portion of the original charge of refrigerant within the circuit 10 from escaping into the atmosphere.

If refrigerating systems are provided with the refrigerant gas purging and reclaiming system of the instant invention, it is estimated that approximately 60% of the present loss of refrigerant into the earth's atmosphere may be prevented. Then, by taking into consideration that approximately five million pounds of refrigerant are lost each year from commercial chiller systems, it may be appreciated that the volume of refrigerant gases vented into the atmosphere will be substantially reduced. Furthermore, at the present inflated prices of most refrigerant gases presently used in refrigerated systems a considerable savings in operating expenses will be realized.

Further, the system of the instant invention utilizes conventional components which are low cost items and which, when operatively associated with a refrigeration system, are actually nonoperative until such time as the associated refrigerant system experiences a loss in refrigerant gas. Even then, the system of the instant invention is only operated for a short period of time and thus each refrigerant gas reclaiming system of the instant invention may have a functional life many times the functional life of a typical refrigeration system whose operation is almost continuous. Still further, although the pressure vessel or tank 24 may be relatively large in capacity, or several pressure vessels or tanks 24 may be ganged together, the compressor 30 may be of considerably less capacity than the compressor serially connected in the closed-loop refrigerant circuit 10 of the associated refrigerating system.

In addition, the refrigerant reclaiming system of the instant invention monitors the pressure of refrigerant gas in an associated refrigeration system 365 days a year and that the system of the instant invention can be modified, capacity wise, to accommodate any refrigeration system. Further, the system of the instant invention requires minimal energy usage, when actuated, and requires little maintenance. Also, the system of the instant invention will substantially reduce the amount of refrigerant gas which may be taken from a refrigeration system by a thief and substantially reduces a refrigerant service person's time by having already evacuated a refrigerant system upon which maintenance is to be performed as a result of a refrigerant leak by the time the refrigeration system maintenance person reaches the site. Still further, assuming that the system of the instant invention is actuated upon a reduction of operating pressure to 55 psi, and the attendant refrigeration system includes an automatic shut down system which does not function until an operating pressure of considerably less than 55 psi is sensed, the system of the instant invention constitutes a saving to consumers and insurance companies from costly repairs due to damages caused by improper functioning refrigeration systems. Furthermore, it will reduce, drastically, the amount of refrigerant gases which may be illegally vented from a refrigeration system upon which maintenance is being performed.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. An accessory apparatus, for monitoring the refrigerant gas in a closed-loop refrigeration circuit having a low pressure refrigerant line and for evacuating and storing said gas upon detection of a drop of gas pressure in said low pressure refrigerant line to a predetermined level, which comprises a purge line including an inlet end and an outlet end, said inlet end being adapted to open into said low pressure refrigerant line, a storage vessel, said outlet end opening into said storage vessel, electric motor driven compressor means serially connected in said purge line for pumping refrigerant from said low pressure refrigerant line into said storage vessel, an electrically operated, normally closed, flow control valve serially connected in said purge line, electrical circuit controlling and pressure sensing switch means communicated with said low pressure refrigerant line, timer means, a normally open power circuit in which said control valve, timer means and compressor means are electrically connected, said pressure sensing switch means being operative to close said power circuit and thereby open said flow control valve and actuate said compressor means and timer means, said timer means, after being actuated, being operative to open said power circuit after a predetermined time interval and to thus terminate operation of said compressor means and allow said flow control valve to close.

2. In combination, a refrigeration system including a closed-loop refrigerant circuit having a low pressure refrigerant line upstream from a compressor and wherein the normal operating pressure of refrigerant in said low pressure refrigerant line falls within a predetermined range of pressure above atmospheric pressure, an accessory refrigerant purging and storage system including a purge line having an inlet and an outlet end, said inlet end opening into said low pressure refrigerant line, a storage vessel, said outlet end opening into said storage vessel, compressor means serially connected in said purge line, said refrigerant purging system further including control means operatively associated with said purge line, compressor means and low pressure refrigerant line operative to sense a drop in pressure in said low pressure refrigerant line to a predetermined pressure below said range of pressure and to drive said compressor means, responsive to said drop in pressure, for a predetermined time period, only, and to thereafter terminate operation of said compressor means and prevent backflow of refrigerant from said storage vessel into said low pressure refrigerant line.

3. The combination of claim 2 wherein said purge line includes condenser means serially connected therein intermediate said compressor and storage vessel operative to cool said pumped refrigerant before entering said pressure vessel.

4. The combination of claim 2 wherein said control means includes notification means operative to render a notification signal upon said compressor means being driven.

5. The combination of claim 4 wherein said purge line includes condenser means serially connected therein intermediate said compressor and storage vessel operative to cool said pumped refrigerant before entering said pressure vessel.

6. The method of limiting refrigerant loss to the exterior of a closed-loop refrigerant circuit and reclaiming and storing refrigerant remaining in said circuit wherein said circuit includes a low pressure refrigerant line upstream from a compressor and the normal operating pressure of refrigerant in said low pressure refrigerant line falls within a predetermined range of pressure above atmospheric pressure, said method including providing a refrigerant purging line including inlet and outlet ends and having compressor means serially connected therein as well as a flow control valve upstream from said compressor means, providing a refrigerant storage vessel into which said outlet end opens, communicating said inlet end with said circuit, and, responsive to a drop in pressure in said low pressure refrigerant line to a predetermined level slightly below said range of operating pressure, opening said flow control valve and driving said compressor means for a predetermined time, only, and, upon termination of said predetermined time period, closing said flow control valve and terminating drive of said compressor means.

7. The method of limiting refrigerant loss to the exterior of a closed-loop refrigerant circuit including a low pressure refrigerant line upstream from a compressor and wherein the normal operating pressure of refrigerant in said low pressure refrigerant line falls within a predetermined range of pressure above atmospheric pressure, said method including communicating said circuit with the interior of a pressure vessel, sensing a drop in operating pressure in said low pressure refrigerant line to a predetermined pressure below said range of operating pressure, and, responsive to said predetermined pressure being sensed, pumping refrigerant from said circuit and into said pressure vessel for a predetermined time period, only, and, upon termination of said time period terminating the pumping of refrigerant and preventing backflow of refrigerant from said pressure storage vessel into said circuit.

* * * * *